US005927716A

United States Patent [19]

Goodson et al.

[11] Patent Number: 5,927,716

[45] Date of Patent: Jul. 27, 1999

[54] GAME TICKET PROTECTION SYSTEM

[75] Inventors: Jonathan M. Goodson, Beverly Hills; Peter R. Berlin, Toluca Lake; Ernest W. Fiedler, Valley Village, all of Calif.

[73] Assignees: Fiedler/Berlin Productions, Inc., Toluca Lake; Jonathan Goodson Formats, LLC., Los Angeles, both of Calif.

[21] Appl. No.: 08/884,684

[22] Filed: Jun. 27, 1997

Related U.S. Application Data

[60] Provisional application No. 60/021,150, Jul. 1, 1996.

[51] Int. Cl.[6] ..... A63F 3/06

[52] U.S. Cl. ..... 273/269; 273/139

[58] Field of Search ..... 273/269, 139, 273/270, 268; 463/17

[56] References Cited

U.S. PATENT DOCUMENTS

| | | | |
|---|---|---|---|
| 4,466,614 | 8/1984 | Bachman et al. . | |
| 4,738,473 | 4/1988 | Meloni et al. . | |
| 4,964,642 | 10/1990 | Kamille . | |
| 5,002,313 | 3/1991 | Salvatore . | |
| 5,046,737 | 9/1991 | Fienberg . | |
| 5,232,221 | 8/1993 | Sludikoff et al. . | |
| 5,269,523 | 12/1993 | Boylan et al. | 273/269 X |
| 5,386,985 | 2/1995 | Paris | 273/269 |
| 5,451,052 | 9/1995 | Behm et al. . | |
| 5,518,239 | 5/1996 | Johnston | 273/139 |
| 5,641,167 | 6/1997 | Behm et al. | 273/269 |
| 5,657,991 | 8/1997 | Camarato | 273/269 |
| 5,772,510 | 6/1998 | Roberts | 273/139 X |

*Primary Examiner*—William E. Stoll
*Attorney, Agent, or Firm*—Henry M. Bissell

[57] ABSTRACT

In order to prevent stockpiling of tickets and to encourage the purchase of more tickets, a system is provided whereby game instructions are announced subsequent to distribution of the tickets. The game instructions notify the players as to which game areas in a ticket playing field they must unmask in order to win the interactive game of chance. The game instructions may be announced during a television program or radio broadcast or any other similar promotional activity and provide the players with the incentive to purchase tickets and to participate in the viewing or listening of the program or other promotion. To safeguard against stockpiling of old tickets, play areas that are not unmasked in accordance with the play instructions automatically invalidate the tickets. Unmasking of the play areas is undisguisable, allowing the game sponsor to readily determine which play areas have been revealed in accordance with the play instructions and which are in violation therewith and are, accordingly, invalid. Unmasked tickets which do not possess a winning combination can never be a winner.

7 Claims, 3 Drawing Sheets

GAME TICKET PROTECTION SYSTEM

CROSS-REFERENCE TO RELATED APPLICATION

This application claims the benefit of U.S. Provisional Application No.: 60/021,150, filed Jul. 1, 1996.

BACKGROUND OF THE INVENTION

1. Field of the Invention

The invention relates to tickets issued to players for delayed or second play use in an interactive system, such as a television program. The system protects against possible re-use of non-winning tickets, thus eliminating any benefit from stockpiling tickets.

2. Description of the Related Art.

Lottery and similar type games using printed tickets generally fall into one of two categories. The first involves "on-line" or custom-generated tickets, the information of which includes a validity date and is printed on the ticket at the time of distribution.

The second category involves pre-printed tickets which cannot have validity dates printed on them because there are no adequate inventory control systems in place to allow sponsors of the game to know which tickets have been distributed and which are still in inventory and, most importantly, which tickets have been distributed within an applicable sales period. This problem of inadequate inventory control persists even when the tickets are provided with a unique identifying number.

The absence of a validity date presents the sponsor or Game Provider with a problem that the players have an unlimited pool of tickets with which to participate in an interactive "Second Play" game which the sponsor may choose to hold at some time after a first, possibly "instant", play. A second play would involve, for instance, the players' interaction with a television program, with the game sponsor broadcasting to the players game instructions and information which the players correlate with the tickets in their possession to determine if they are winners of the Second Play game. However, without adequate inventory control, all tickets distributed since the beginning of the promotion become eligible to win the Second Play game, creating an incentive for players to stockpile old tickets and a disincentive to acquire new tickets on an ongoing basis. Since the original purpose of the ticket was to induce a new sale, or induce repeat retail visits, adding a second play in this situation actually harms the overall promotion.

The prior art has failed to either recognize or address this problem of stockpiling tickets. U.S. Pat. No. 4,466,614 to Bachman et al. is for a game in which players scratch off appropriate markings on a ticket to designate answers to a puzzle presented by the game. Rather than chance, skill is involved in producing winners. The patent makes no mention of second play and is not concerned with the stockpiling of tickets.

U.S. Pat. No. 4,738,473 to Meloni et al. provides a scheme for exposing possible tampering with tickets which are imprinted at the point of sale. The point-of-sale printing process affords the ticket issuer control over the parameters of the game. However, second play is not addressed.

U.S. Pat. No. 4,964,642 to Kamille discloses a game in which the players are also guided by their own skill rather than chance. The players sequentially expose clues on a ticket regarding the identification of a particular subject, with each succeeding exposure diminishing the value of the prize for which the ticket can be redeemed. A ticket is used only once.

U.S. Pat. No. 5,002,313 to Salvatore shows a ticket in which the player, in answering a question posed by the ticket, is permitted to select a limited number of answer regions provided on the ticket. The answer regions irreversibly reveal answers, and revealing more than one of the competing answers invalidates the ticket.

U.S. Pat. No. 5,046,737 to Fienberg is for a lottery game in which players use lottery tickets, each having a plurality of groups of game symbols to thereby provide the players with multiple plays. The players acquire two types of playing tickets having printed indicia which is correlated to designate winners of the game. No provisions for interactive play are made in the patent.

U.S. Pat. No. 5,232,221 to Sludikoff et al. is of the on-line custom-generated ticket-type lottery game. As such, the patent is not concerned with the problems attendant to the preprinted-type lottery games of this invention.

U.S. Pat. No. 5,451,052 to Behm et al. is for preprinted lottery tickets for a lottery game. No provisions are discussed for interactive second play and the patent therefore fails to address the concerns of the invention.

SUMMARY OF THE INVENTION

In accordance with the invention, a ticket for the game comprises a Field portion having a plurality of Play Areas. The arrangement of the Play Areas makes it impossible for a player to gain an advantage by stockpiling tickets, which is a problem with presently known ticket game systems which provide for second play events.

The Field is masked, as by latex (for "scratch-off"), pull-tabs or any other suitable technique so that play data is concealed. Once revealed, the fact that the mask has been altered cannot be disguised. This feature is not novel, as it is common in all scratch tickets.

The Play Areas are visibly differentiated using a variety of different labels, as by numbers, letters, colors, words, symbols, etc. Each Play Area masks a piece of "Game Information" which, when properly revealed, indicates to the player whether or not he has won his interactive play and, if a win, how much he has won. To properly reveal a Play Area, the player must first remove its mask.

In conducting a second play for the ticket holders, the Game Provider announces (via TV, radio, newspaper, in-store poster or the like) (1) which Play Area(s) are to be unmasked and (2) what Game Information constitutes a win. If a ticket holder wishes to play, he unmasks the designated Play Areas and checks the Game Information to determine if it is of a winning nature.

Redemption of winning tickets can be done in any way that allows the Game Provider to examine the ticket to ascertain that only the designated Play Areas have been revealed. If others are unmasked, the ticket is invalidated.

If an unmasked ticket is not a winner on this play, it can never be a winner. Even if the same Play Areas were specified another time, the result would be the same. Once a ticket is found to be a loser, it is always a loser. Thus there would be no incentive to save it for another play in the future and the problem with present second play systems is eliminated.

A significant feature of the invention is that the Game Provider specifies which Play Areas to unmask. No prior games having this feature are known.

The invention provides a new system for preventing players of lottery or "pull-tab" coupons or similar games (herein collectively "Tickets") who use the Tickets to play interactively at home from stockpiling non-winning Tickets and using them to produce "wins" at a later date.

In the prior art there are generally two types of tickets: pre-printed Tickets and "on-line", custom generated tickets. Our application is for pre-printed Tickets only, since the custom tickets are issued with a validity date printed right on them. Although each Ticket often has a unique identifying number printed on it, there are no adequate inventory control systems in place to allow issuers of tickets to know which Tickets have been distributed or are still in inventory, and most importantly, which Tickets have been distributed within an applicable sales period. For the "instant" part of the ticket, this creates no problem: the player is either a winner or not right on the spot. But if the ticket Issuer wants to create an opportunity for a "Second Play" at a later time, whether via an interactive watch-and-win promotion, or any other kind of promotion, the lack of inventory control creates some serious problems.

For example, suppose the Second Play the Ticket Issuer wants is a weekly interactive event associated with a TV show, whereby a class of Ticket holders will be designated as "winners". Since all Tickets are already uniquely labeled, he could simply say "All Tickets ending in 34 are winners". The problem with this approach is that all the Tickets distributed since the beginning of the promotion are eligible to win, and not just those distributed within the last week.

This creates an incentive for players to stockpile old tickets, and it creates a disincentive for players to acquire new Tickets on an ongoing basis. Since the original purpose of the Ticket was to induce a new sale, or induce repeat retail visits, adding a Second Play actually harms the overall promotion.

In accordance with the invention, a unique play system designed to prohibit players from stockpiling Tickets is provided. The play system limits the player to only one Second Play per Ticket, because once used for a Second Play, the system renders the Ticket worthless for additional attempts at a Second Play. This unique feature is absent from the prior art because, for example, simple Bingo tickets and the like can be stockpiled and reused.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENT

Figure 1:
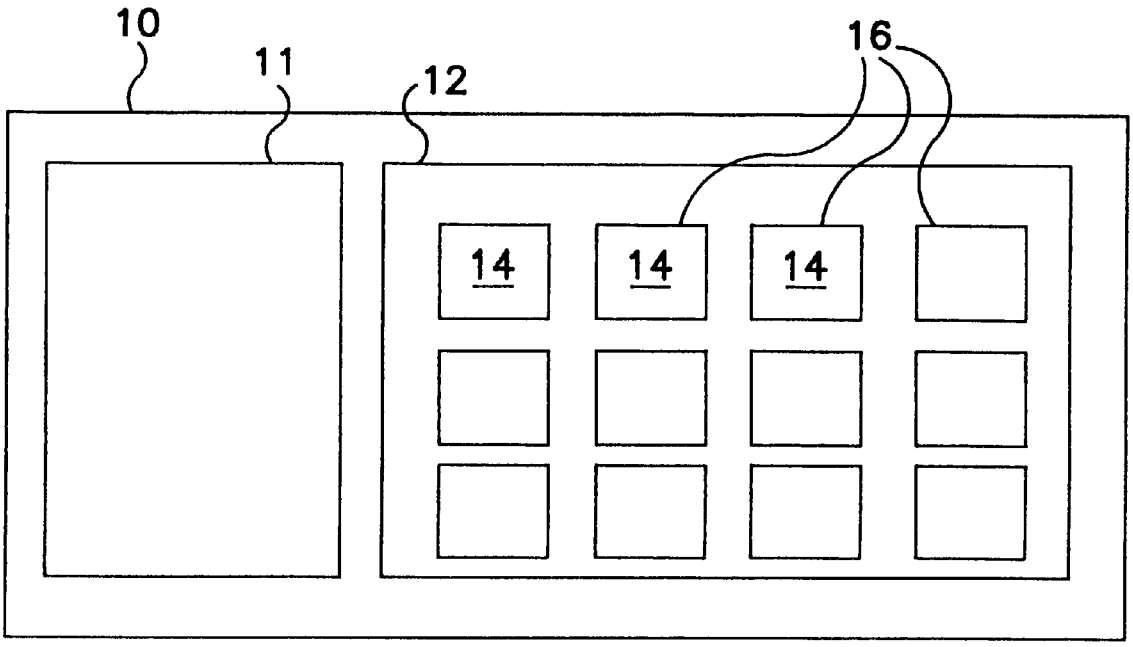
FIG. 1 is a schematic view of one particular arrangement in accordance with the invention.
Figure 2:
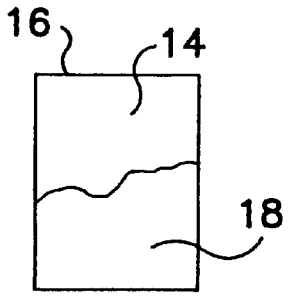
FIG. 2 is a view, partially broken away, of one of the elements shown in FIG. 1.

FIG. 1 schematically represents a ticket 10 to be used in playing the Game which is involved in the interactive system described herein. In addition to anything else on the Ticket, such as an "instant play" game disposed in playing field 11, an additional interactive playing field 12 is placed as follows:

1. Each field 12 is "masked" by masking material 14 (such as latex, "pull-tab", or any other technique) so that play data is not discernible until revealed, but once revealed, the fact that it has been revealed cannot be disguised. This approach is common to all scratch tickets, and we do not make any claims with respect thereto.

2. Each field 12 consists of a discrete number of demarcated "Play Areas" 16; the Play Areas can be differentiated using a variety of different labels; such as number, letter, symbol, color, word, etc.

3. Each Play Area masks a piece of "Game Information" in the form of a game information set 18. The total Game Information derived from game information sets properly unmasked by the player tells him whether he has won or lost his interactive play, and if a win, how much he has won. Improperly unmasked play areas invalidate the ticket, as described below. Game Information can take any number of forms: e.g., (i) match n of N, (ii) exceed, stay below, or hit a stated total, etc. The present invention is not restricted to any particular formula for determining what Game Information constitutes a win.

4. Each time the game provider wishes to conduct a Second Play for its Ticket holders, it announces (via TV, radio, newspapers, press release, store posting, or any other method) two things:

A. Which Play Areas are to be revealed by the player.

B. What Game Information will constitute a "win".

Any player holding a Ticket who wishes to participate can then do so by proceeding to reveal the appropriate Play Areas, and determining if the Game Information so revealed is of a winning nature.

5. Redemption of winning tickets can be done in any manner that allows the game provider the opportunity to examine the ticket to assure that only the designated Play Areas have been revealed. If any other Play Areas have been revealed, the Ticket is invalidated.

6. Once a player has properly played the Secondary Play of the Ticket, he will find that the revealed Game Information either produces a win or a loss. If a win, he will redeem it; if a loss, he will discard it, since even if the game provider should later select the exact same Play Areas for use a second time, the losing Game Information on this particular Ticket, having been revealed, will continue forever to be losing Game Information. The player will thus have no incentive to stockpile old Tickets: their Secondary Plays will be either winners or losers at the time the Play Areas are revealed.

Figure 3:
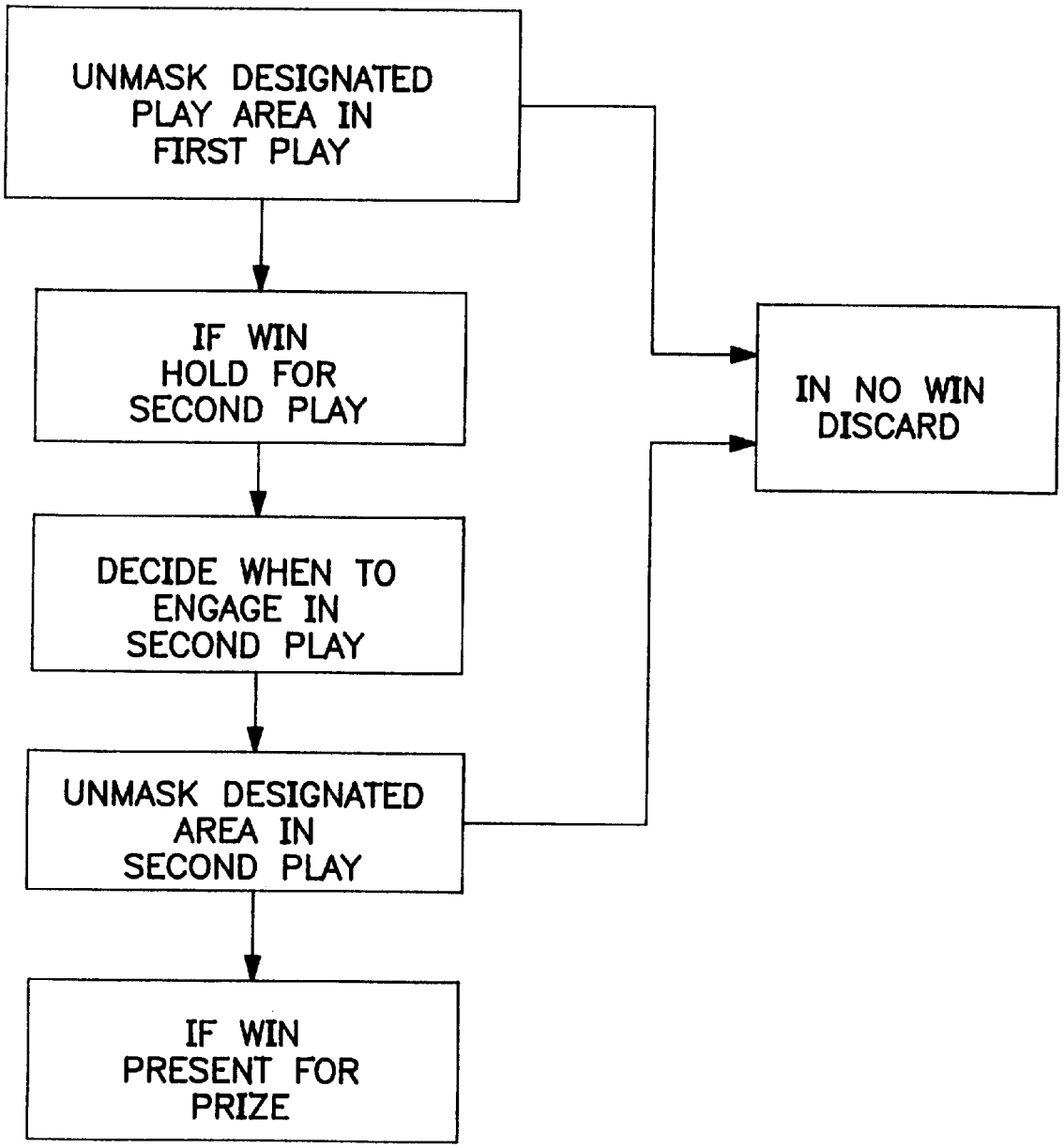
FIG. 3 is a flowchart schematically representing the utilization of the arrangement of FIG. 1 in play of the related game.
Figure 3A:
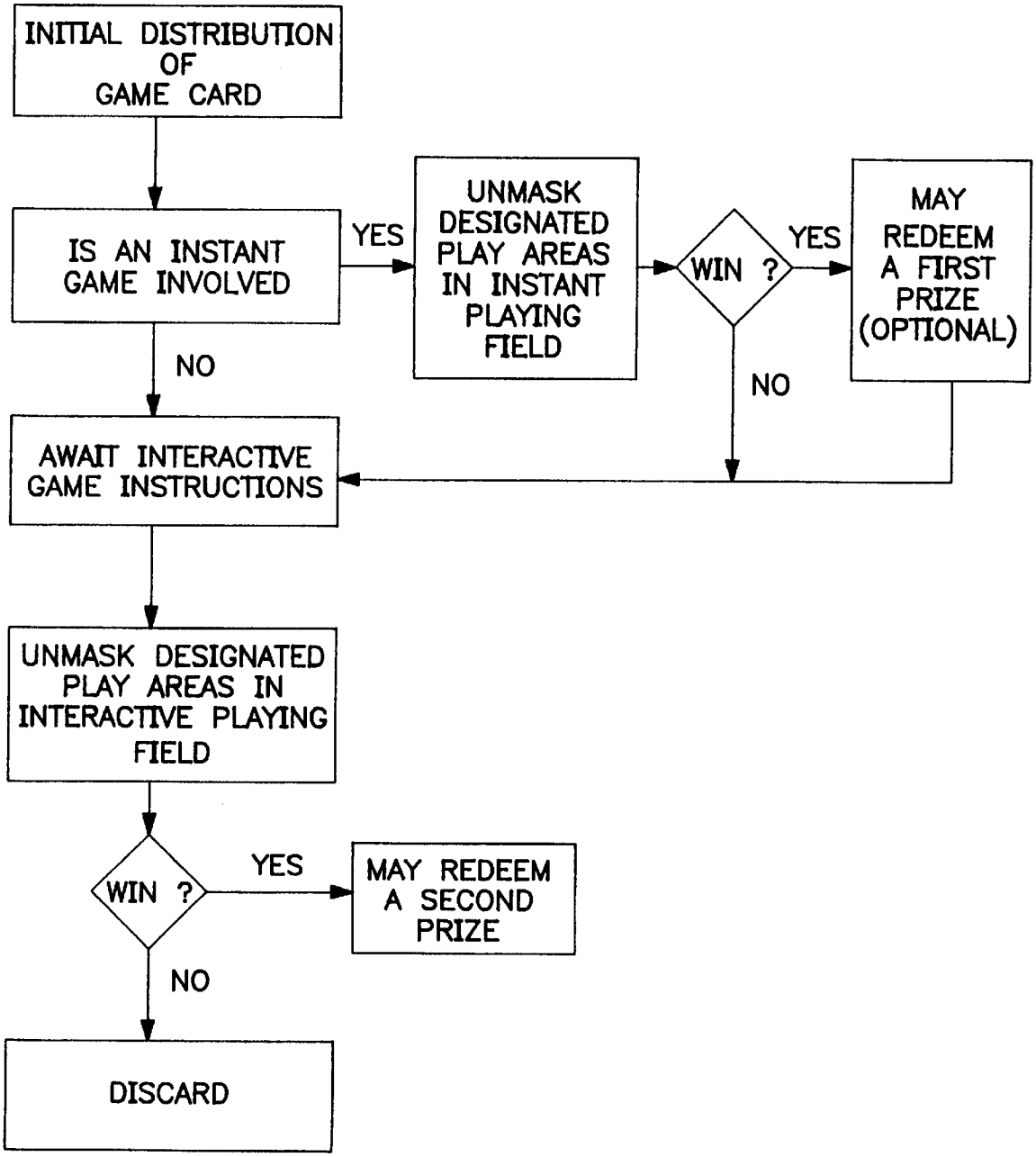
FIG. 3A is another flowchart representing an expansion of the flowchart of FIG. 3, illustrating further details of play in the practice of the invention.

FIG. 3 illustrates schematically the game play procedure in accordance with the invention. The player purchases a ticket which may contain an instant play field and an interactive play field. If an instant play field is involved the player proceeds to unmask designated areas in accordance with the rules of the instant play game. At that point, the player is able to determine whether or not he has won the instant play game. If he is a winner then he has the option of redeeming the ticket or of retaining it and participating in the interactive game at a subsequent time. This does not necessarily mean that he forfeits his right to redeem the first prize.

To play the interactive game, the player awaits instructions which he will receive through any means such as a television program, newspaper publication, supermarket announcement, etc. The instructions thus received apprise the player as to which play areas in the interactive playing field are to be unmasked. Additionally, the instructions spell out that information which will cause a particular ticket to be a winner in the interactive game. As an example, the game instructions can tell the players that the red play areas in the instant playing field are to be unmasked, and that if the numbers revealed by the unmasking have a sum exceeding 50 that ticket is a winner. A player who properly unmasks the game areas on the interactive playing field—that is, a player who in this example has only unmasked the red playing areas—and has revealed numbers whose sum exceeds 50 is thus a winner. The player is then eligible to redeem a second prize in addition to the first prize he had won during the instant game. Even if he had not won a first prize, this same player may still be eligible to win the second prize due to his success in the interactive play game. However, players who have neither won the instant game nor the interactive game discard their tickets. No advantage will be gained by a non-winner's retention of a ticket for subsequent interactive game play because the non-winning combination will not be repeated. Specifically, the game provider, even if he designates the same playing areas are to be unmasked again, will require different relationships of the game areas to render a ticket a winner.

Thus, the present invention provides the solution to a problem which has been encountered in games of chance which are designed to provide a second play for a given ticket at a later time to be selected by the game provider. That problem involves the possible re-use of tickets which had previously been determined not to have the winning combination. Until now, players could benefit from stockpiling tickets to use at a later date, thereby eliminating the benefit to the game provider of having successive plays at different times for interactive games. Practice of the present invention prevents a ticket which has been used by the ticket holder in a Second Play game from ever winning, once it has been determined that the ticket he holds is a loser.

Although there have been described hereinabove various specific arrangements of a game ticket protection device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A method of play for an interactive game of chance between players and a sponsor or Game Provider in which winners are distinguished as possessing tickets having winning game information derived from at least one game information set, said method comprising:

distributing to each player at least one ticket having demarcated thereon at least one playing field, said playing field having a plurality of play areas each containing a game information set and each being distinguishable from the other by a distinct marking associated therewith, said play areas each being concealed by a corresponding impermanent mask adapted for removal by the player, said removal being undisguisable; and announcing play instructions designating a select group of play areas as active play areas whose game information sets operate to differentiate a class of tickets as winners in accordance with a prescribed win parameter.

2. The method of claim 1, wherein said play instructions contain a prescribed win parameter.

3. The method of claim 1, wherein each ticket is provided with a second playing field for yielding a winner in an instant play game conducted separately from said interactive game.

4. The method of claim 1, wherein each of said plurality of play areas is differentiated by at least one of a variety of identifiers comprising numbers, letters, colors, words and symbols.

5. The method of claim 1, wherein said announcing of additional play instructions designating a select group of play areas as active play areas serves to differentiate an additional class of winners as possessing at least one game ticket having winning game information derived from said additional play areas announced by said Game Provider.

6. The method of claim 1, wherein said method of play further comprises providing a unique play system to eliminate any incentive for players to accumulate previously played tickets for use in future games wherein said play system limits each ticket with respect to the number of possible additional plays, thereby rendering worthless any attempted plays beyond the additional plays permitted by the Game Provider.

7. The method of claim 1, wherein said method of play further comprises:

preventing players from reusing tickets from prior play by limiting players to only one additional play per ticket, thereby rendering each ticket worthless for additional attempts at a Second Play.

* * * * *